US010683143B2

(12) United States Patent
Kneer et al.

(10) Patent No.: US 10,683,143 B2
(45) Date of Patent: Jun. 16, 2020

(54) STOPPER FOR A CONTAINER

(71) Applicant: Gaplast GmbH, Altenau (DE)

(72) Inventors: Stephan Kneer, Farchant (DE); Roland Kneer, Farchant (DE)

(73) Assignee: Gaplast GmbH, Altenau (DE)

( * ) Notice: Subject to any disclaimer, the term of this patent is extended or adjusted under 35 U.S.C. 154(b) by 0 days.

(21) Appl. No.: 15/668,853

(22) Filed: Aug. 4, 2017

(65) Prior Publication Data

US 2018/0037374 A1 Feb. 8, 2018

(30) Foreign Application Priority Data

Aug. 4, 2016 (DE) ..... 10 2016 009 417

(51) Int. Cl.

| | |
|---|---|
| ***B65D 39/16*** | (2006.01) |
| ***B65D 50/06*** | (2006.01) |
| ***B65D 51/30*** | (2006.01) |
| *B65D 39/00* | (2006.01) |

(52) U.S. Cl.

CPC ..... *B65D 39/16* (2013.01); *B65D 50/069* (2013.01); *B65D 51/30* (2013.01)

(58) Field of Classification Search

CPC ..... B65D 39/16; B65D 50/069; B65D 51/30
USPC ..... 215/299, 298, 300, 305; 220/212.5
See application file for complete search history.

(56) References Cited

U.S. PATENT DOCUMENTS 3,625,386 A * 12/1971 Schaefer ..... B65D 50/067 215/215
3,792,803 A * 2/1974 Kessler ..... B65D 47/286 215/315
4,358,022 A * 11/1982 Geiger ..... B65D 51/26 215/224
4,458,819 A * 7/1984 Geiger ..... B65D 50/069 215/224
4,535,903 A * 8/1985 Franchi ..... B65D 50/069 206/534
5,287,982 A * 2/1994 Tsai ..... B65D 41/0485 215/305
5,299,702 A * 4/1994 Kneer ..... B65D 39/16 215/256
6,102,259 A * 8/2000 Tsamourgelis ..... B65D 47/305 222/511

(Continued)

OTHER PUBLICATIONS

U.S. Appl. No. 15/668,845 entitled "Container Closure System", Inventor: Kneer, Stephan et al., filed Aug. 4, 2017.

(Continued)

*Primary Examiner* — J. Gregory Pickett
*Assistant Examiner* — Niki M Eloshway
(74) *Attorney, Agent, or Firm* — Greer, Burns & Crain, Ltd.

(57) ABSTRACT

The stopper for a container having a container opening, in which opening the stopper, having an olive that is molded onto a head segment of the stopper, engages in a force fit, wherein a slide element is arranged in the head segment in a recess leading through the center of the head segment and is guided in lateral grooves such that said slide element may be advanced beyond the lateral edge of the head segment as a grip for removing the stopper from the container, is characterized in that a tension band is attached on the top of the head segment and connects the two longitudinal sides of the recess and covers the slide element with little clearance.

13 Claims, 2 Drawing Sheets

(56) References Cited

U.S. PATENT DOCUMENTS

| | | | | |
|---|---|---|---|---|
| 8,556,137 | B2 * | 10/2013 | Vogel | B65D 47/0895 222/143 |
| 2001/0025865 | A1 * | 10/2001 | Bravo | B44D 3/127 222/465.1 |
| 2007/0246467 | A1 * | 10/2007 | Kneer | B65D 39/16 220/254.9 |
| 2009/0101621 | A1 * | 4/2009 | Kneer | B65D 39/16 215/355 |
| 2015/0053579 | A1 * | 2/2015 | Lebon | B65D 81/264 206/204 |

OTHER PUBLICATIONS

U.S. Appl. No. 15/668,869 entitled "Container Closure System", Inventor: Kneer, Stephan et al., filed Aug. 4, 2017.

* cited by examiner

STOPPER FOR A CONTAINER

PRIORITY CLAIM

The subject application claims convention priority to German patent application No. 10 2016 009 417.6 filed Aug. 4, 2016.

FIELD OF THE INVENTION

The invention relates to stoppers for containers.

SUMMARY OF THE INVENTION

The invention relates to a stopper for a container having a container opening, in which opening the stopper, having a projection commonly known as an olive, engages in a force fit, wherein the olive is embodied integrally with a head segment of the stopper that has, in its top, a recess that leads through the center of the head segment and in which a slide element is arranged. The slide element is guided in lateral grooves and, as a grip for removing the stopper from the container, may be advanced beyond the lateral edge of the head segment and then grasped from below to lift the stopper from the container.

In the previously known stoppers of this type, it can happen that the slide element is pulled out of the recess if the olive is seated in a very tight force fit in the container opening. This then leads to a situation in which it is no longer possible to use the slide element to assist in removing the stopper from the container.

The underlying object of the present invention is to improve a stopper of the aforesaid type such that using its slide element it may be reliably lifted from a container.

This object is inventively attained by a stopper for a container having a container opening, in which opening the stopper, having an olive that is molded onto a head segment of the stopper, engages in a force fit. A slide element is arranged in the head segment in a recess leading through the center of the head segment and is guided in lateral grooves such that said slide element may be advanced beyond the lateral edge of the head segment as a grip for removing the stopper from the container. A tension band is attached on the top of the head segment and connects the two longitudinal sides of the recess and covers the slide element with little clearance. Further, advantageous embodiments are described herein below.

The invention provides that a tension-band is attached on the top of the head segment and connects the two longitudinal sides of the recess and covers the slide element with little clearance. The tension-band, which preferably comprises the same material as the stopper, i.e., a relatively hard, practically unelastic plastic such as LPDE, holds the two longitudinal sides of the recess at their original spacing from one another so that the two longitudinal sides of the recess cannot be pressed away from one another laterally, even with a great force. The tension-band also covers the slide element with little clearance such that the slide element may be moved freely under the tension-tab. This reliably ensures that the slide-element cannot be pulled out of the guide grooves and that it can be pushed back into the starting position after the stopper is reattached to the container.

The tension-band is preferably embodied as an annular flat strip that is integrally embodied with the rest of the head segment.

In another embodiment of the invention, the head segment of the stopper has an edge that broadens conically downward and in which is inserted, in the starting position, a likewise conically shaped edge segment or grip segment of the slide element, wherein the back end of the slide element is positioned against the edge of the head segment.

It is particularly advantageous that the tension-band or the annular flat strip covers the slide element immediately adjacent to the grip segment of the latter, since this is where the greatest forces occur when the stopper is lifted. The tension-band preferably extends to the back end segment of the slide element, but does not cover the end segment of the latter.

The tension-band reliably prevents the slide element from being pulled out of the head segment, since the tension-band reliably holds together the two longitudinal sides of the recess in which the slide element is seated, wherein the arrangement of the slide element in the recess is naturally also secured due to its being covered with the tension-band.

On its top the tension-band may have at least one annular thickening that increases the strength of the relatively thin, flat strip. The annular strip preferably has an annular thickening on both the radial interior and the radial exterior.

The slide element is preferably guided, with molded-on lateral bars, in grooves that are embodied in the lateral edges of the recess. The lateral bars are preferably integrally joined to the front grip segment or edge segment of the slide element, which enhances the strength of the slide element.

For advancing, the slide element has in its top a recessed grip which a user may use a finger to grip. The slide element may be of a different color than the head segment, so that the user's attention is also drawn to the slide element. The slide element preferably comprises PP or POM.

Addition details of the stopper result from the following description of one preferred embodiment of the stopper and from the drawings.

DETAILED DESCRIPTION OF PREFERRED EMBODIMENTS

Figure 1:
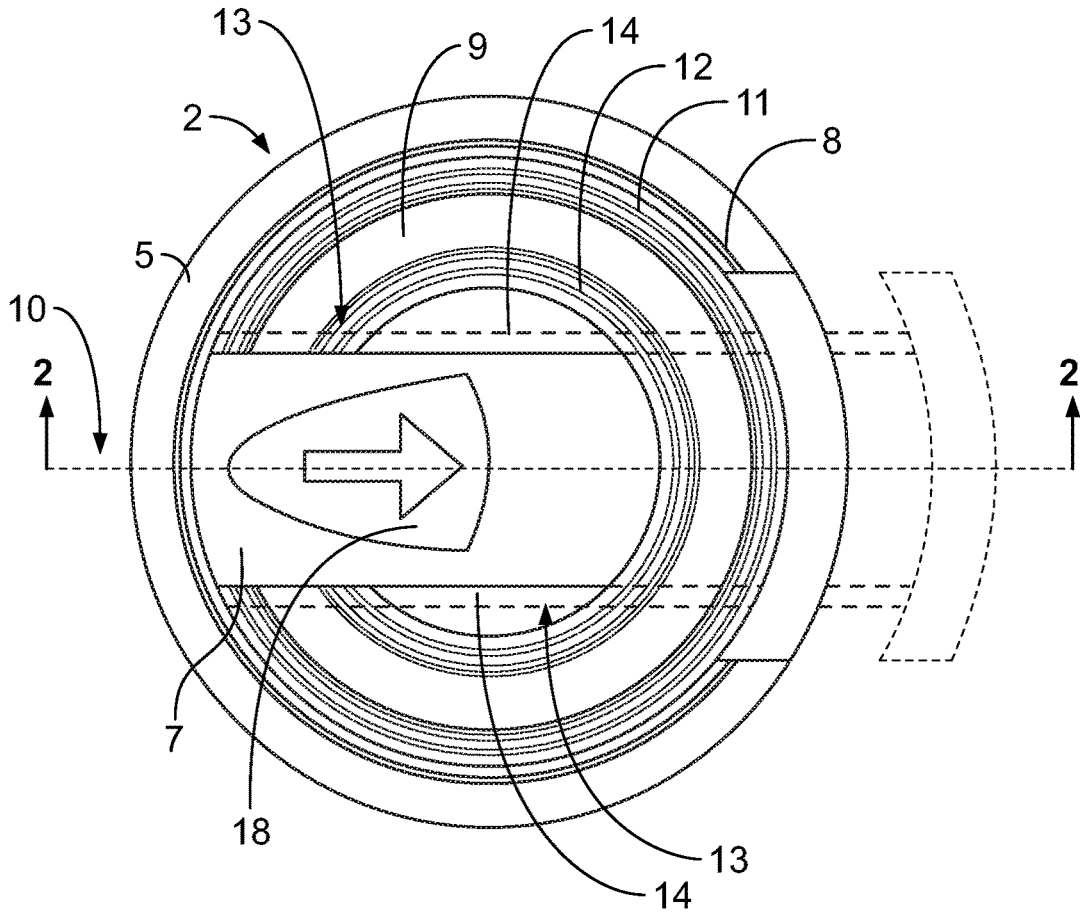
FIG. 1 is a top view of the stopper with the slide element.

The stopper includes an olive 1 that is molded onto the bottom of a head segment 2 of the stopper and that is inserted in a force fit into the container opening of a container (not shown). A desiccant chamber 3 that is filled, for instance, with a loose granulate and is sealed on the bottom, e.g., using a cardboard disk 4, is attached to the head segment 2 radially inside the olive 1.

The head segment 2 includes an annular edge segment 5 that expands downward conically.

The center of the top of the head segment 2 includes a recess 6 that extends from the back edge segment 5 to the front edge of the head segment 2 and into which a slide element 7 is inserted that includes a front edge segment 8 that also extends downward conically and seamlessly integrates with the otherwise annular edge segment 5 of the head segment 2 when the stopper is in the starting position.

An annular tension-band 9 is molded to the top of the head segment 2 and covers the stopper 7 tightly immediately adjacent to the grip segment 8 such that the slide element 7 may be advanced through the tension-band 9 unimpeded. On the back 10 of the stopper the flat tension-band 9 extends to the edge of the recess 6, i.e. without covering the stopper 7 at its back end segment. The top of the tension-band 9 has annular thickenings 11, 12 radially inward and radially outward.

Embodied on the inside of the recess 6 on the lower edge of the lateral walls are longitudinally oriented guide grooves 13 in which lateral bars 14 of the slide element 7 engage so that the slide element 7 is guided along these guide groves during its movement forward and backward. The lateral bars 14 are integrally attached to the grip segment 8. The top of the slide element 7 includes a recessed grip 18.

Figure 2:
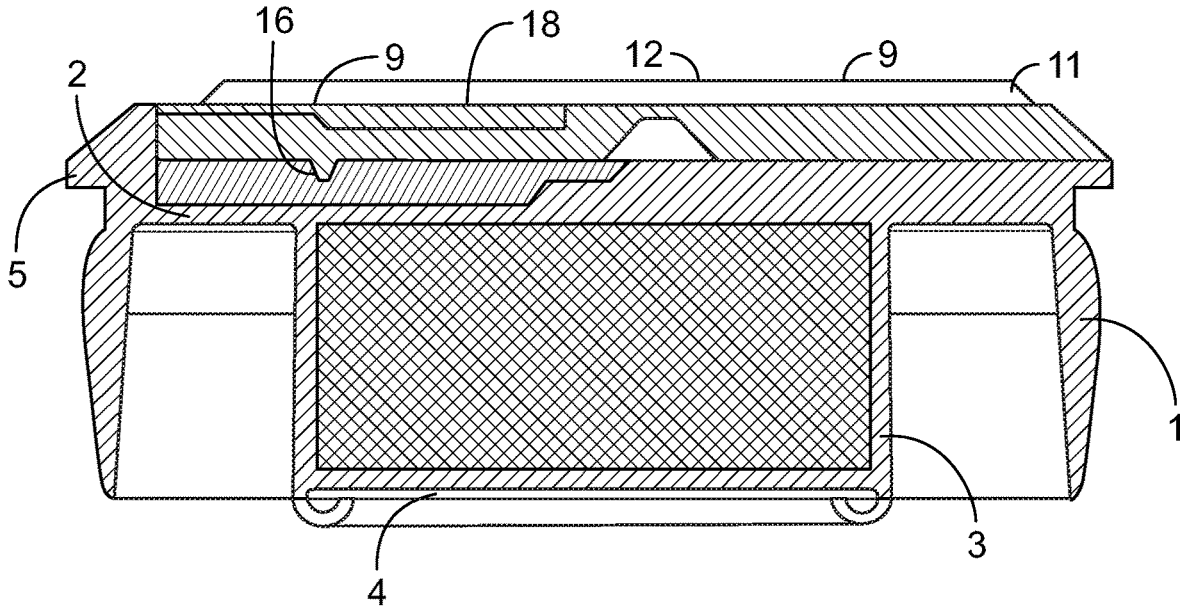
FIG. 2 is a section A-A through the stopper according to FIG. 1.
Figure 3:
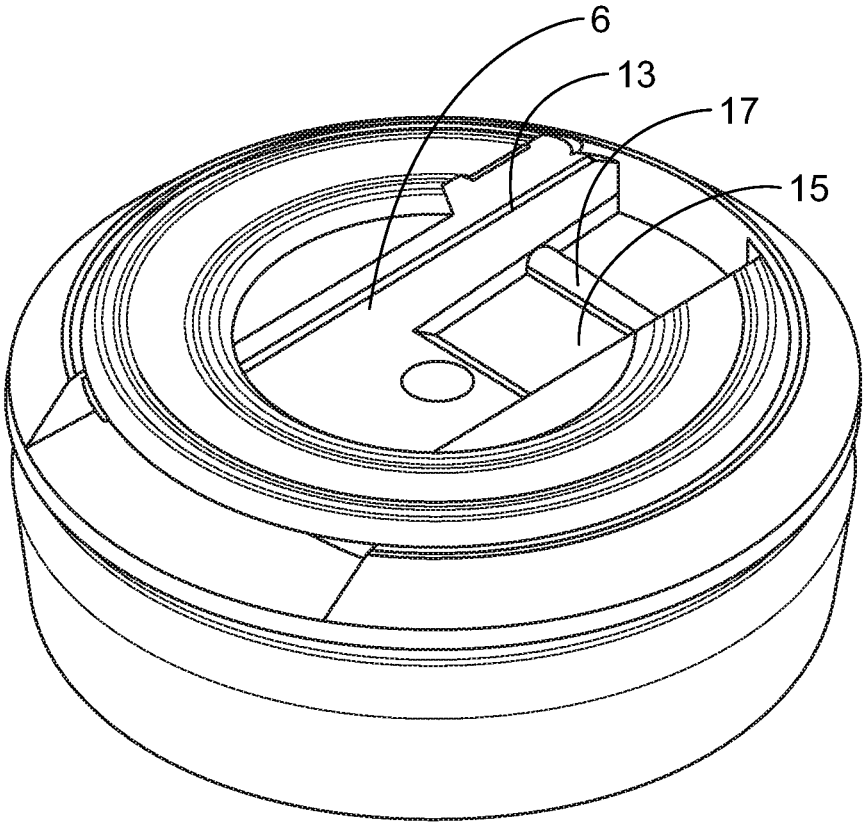
FIG. 3 is a perspective elevation of the stopper without slide element.
Figure 4:
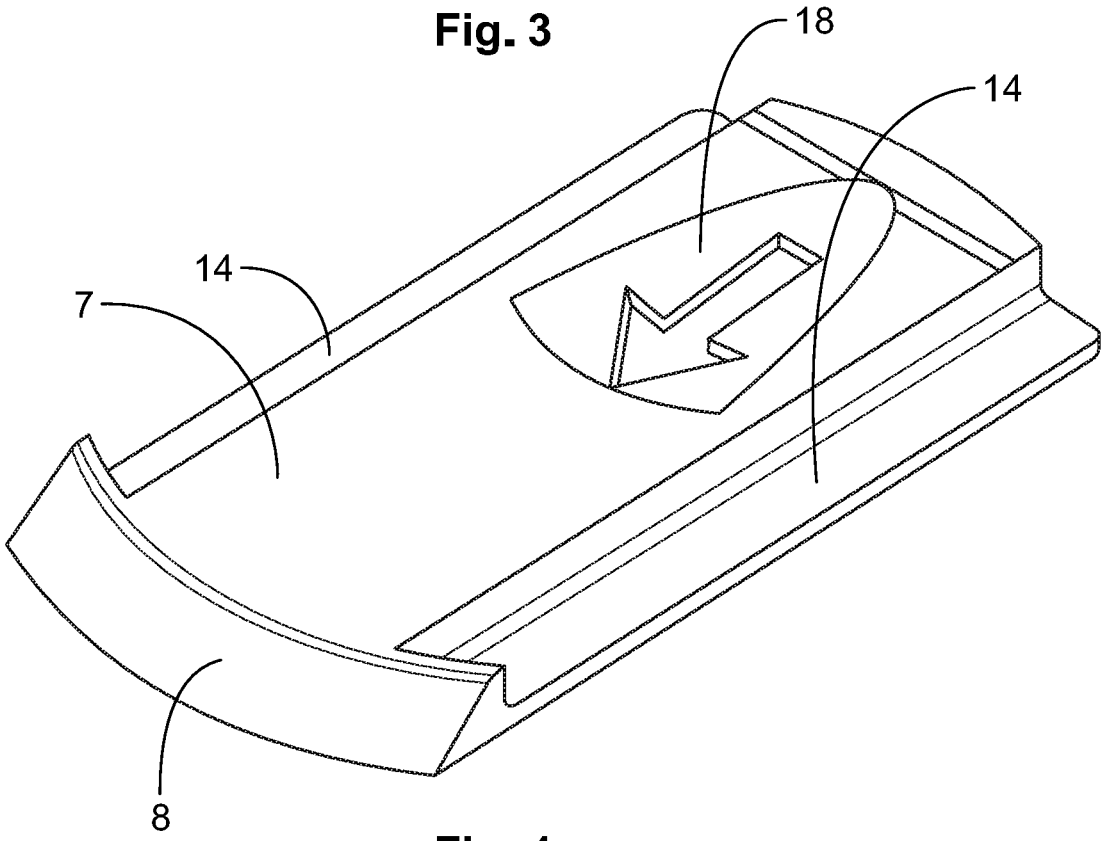
FIG. 4 is a perspective elevation of the slide element.

In order to be able to lift the stopper from a container (not shown), the slide element 7 is advanced in the recess 6, wherein the extended position of the grip segment 8 is drawn in with dot/dash lines in FIGS. 1 and 2. The range of movement for the slide element 7 is limited by a stop 15 on the bottom of the recess 6 and a lower projection 16 of the slide element 7 is positioned against said stop. When the slide element 7 is advanced, first the projection 16 must be pressed over a barrier 17 on the bottom of the recess 6. This barrier secures the slide element when it is not in use and provides an audible and tactile click for the user when it is being closed.

The tension-band 9 holds the lateral walls of the recess 6 at a constant distance from one another in the region of the greatest force so that the lateral bars 14 cannot be pulled upward out of the grooves 13. This also prevents the tension-band from covering the slide element 7. Due to this design, it is always possible to move the slide element 7 inward and outward.

The invention claimed is:

1. A stopper for a container having a container opening, the stopper comprising a head segment;

an olive molded onto the head segment and configured for a force fit in the container opening;

a recess leading through the center of the head segment having spaced apart longitudinal walls with lateral grooves that are undercuts of the walls in the head segment, said lateral grooves each having a depth and a length, wherein the depth of the lateral grooves is the same along the length of the lateral grooves;

a slide element arranged in the recess in the head segment, said slide element having lateral bars that are received within the lateral grooves, and configured to guide the slide element in the lateral grooves such that said slide element may be advanced by a recessed grip at a rear end on the top of the slide element, beyond a lateral edge of the head segment as a grip for removing the stopper from the container; and a tension band connected to longitudinal walls of the recess adjacent to an edge of the head segment, wherein said tension band is a flat strip that covers the slide element with little clearance.

2. The stopper according to claim 1, wherein the tension band is integrally formed with the head segment.

3. The stopper according to claim 1, wherein the head segment has an edge that broadens conically downward and in which is inserted, in a starting position, a likewise conical front grip segment of the slide element, wherein the back end of the slide element is positioned against the edge of the head segment.

4. The stopper according to claim 1, wherein the tension band covers the slide element immediately adjacent to the grip segment of the latter.

5. The stopper according to claim 1, wherein the tension band extends to the back end segment of the slide element without covering the latter.

6. The stopper according to claim 1, wherein the top of the tension band has at least one annular thickening.

7. The stopper according to claim 1, wherein the lateral bars are connected to the front grip segment of the slide element.

8. The stopper according to claim 1, wherein the slide element is a different color than the head segment.

9. A stopper for a container having a container opening, the stopper comprising:

a head segment;

an olive molded onto the head segment and configured for a force fit in the container opening;

a recess leading through the center of the head segment having spaced apart longitudinal walls with lateral grooves that extend at least partially into the head segment;

a slide element arranged in the recess in the head segment and having lateral bars that guide the slide element in the lateral grooves such that said slide element may be advanced by a recessed grip at a rear end on the top of the slide element between a retracted position within the head segment, and an extended position, beyond a lateral edge of the head segment; and a tension band connected to longitudinal walls of the recess adjacent to an edge of the head segment, wherein said tension band is a flat strip that covers the slide element with little clearance, and wherein the tension band covers less than half of the top surface of the slide element when the slide element is in the retracted position.

10. The stopper according to claim 9, wherein the tension band is integrally formed with the head segment.

11. The stopper according to claim 9, wherein the head segment has an edge that broadens conically downward and wherein when the slide element is in the retracted position, a corresponding conical front grip segment of the slide element is inserted in the edge and the back end of the slide element is positioned against the edge of the head segment.

12. The stopper according to claim 9, wherein the top of the tension band has at least one annular thickening.

13. The stopper according to claim 11, wherein the lateral bars are connected to the front grip segment of the slide element.

* * * * *